US005731533A

United States Patent [19]

Hoshiai

[11] Patent Number: 5,731,533

[45] Date of Patent: Mar. 24, 1998

[54] MUSICAL TONE SIGNAL FORMING APPARATUS FOR USE IN SIMULATING A TONE OF STRING INSTRUMENT

[75] Inventor: Atsushi Hoshiai, Hannan, Japan

[73] Assignee: Roland Corporation, Osaka, Japan

[21] Appl. No.: 701,876

[22] Filed: Aug. 23, 1996

[51] Int. Cl.[6] ..... G10H 1/12

[52] U.S. Cl. ..... 84/661; 84/DIG. 9

[58] Field of Search ..... 84/630, 661, 699, 84/700, 707, 736, DIG. 9, DIG. 26; 381/63–65

[56] References Cited

U.S. PATENT DOCUMENTS 4,625,326 11/1986 Kitzen et al. ..... 84/DIG. 26

5,367,120 11/1994 Hoshiai .

*Primary Examiner*—Stanley J. Witkowski

*Attorney, Agent, or Firm*—Banner & Witcoff, Ltd.

[57] ABSTRACT

A musical tone signal forming apparatus includes a pickup which detects vibrations of a string of an electric guitar and produces a string vibration signal. The string vibration signal and the output of a first delay imparting a first delay time are combined in a first combiner. Second and third delays impart second and third delay times to the string vibration signal, respectively. Delayed signals from the second and third delays are combined in a second combiner. Outputs of the first and second combiners are combined in a third combiner. The first delay time is determined by the distance between a bridge and a first imaginary pickup supposed to detect vibrations of the string. The second delay time is determined by the distance between the first imaginary pickup and a second imaginary pickup supposed to be disposed nearer to the bridge. The third delay time is determined by the distance between the bridge and the mid-point of the first and second imaginary pickups.

20 Claims, 4 Drawing Sheets

MUSICAL TONE SIGNAL FORMING APPARATUS FOR USE IN SIMULATING A TONE OF STRING INSTRUMENT

The present invention relates to a musical tone signal forming apparatus for forming a musical tone of an input audio frequency signal in electric string instruments, such as an electric guitar.

BACKGROUND OF THE INVENTION

U.S. Pat. No. 5,367,120 issued to me on Nov. 22, 1994 discloses an example of apparatus for forming a musical tone or timbre. The musical tone signal forming apparatus disclosed in this patent detects vibrations of a string of an electric guitar as a string vibration signal by means of a pickup disposed at an arbitrary position along the string. The detected signal is applied to a comb filter including a delay which provides a variable delay time. Adjustment of the delay time imparted to the signal by the variable delay can produce a string vibration signal equivalent to a signal which would be detected by the pickup if it were disposed at a different position.

U.S. Pat. No. 5,367,120 discloses also connecting two such comb filters in series to produce a musical sound signal which could be detected by a humbacking pickup, or a musical sound signal which could be produced by an electric guitar with half-tone setting.

A humbacking pickup is constituted by two single coil pickups. A single coil pickup is constituted by a pole of permanent magnet (i.e. pole piece) around which a coil is wound. In the humbacking pickup, two single coil pickups with their coils connected in series are arranged in such a manner that the directions of magnetic fields generated by the respective pole pieces are opposite. The humbacking pickup is twice sensitive to string vibrations relative to a single coil pickup, and is capable of cancelling external noise.

Half-tone setting is a term used in an electric guitar including a plurality of single coil pickups for one string. In the half-tone setting, a tone switch for selecting the pickups is set in an intermediate position between two pickups so that the two pickups are connected in parallel. Thus, U.S. Pat. No. 5,367,120 discloses an apparatus in which a signal detected by one pickup is filtered to simulate signals detected by two imaginary pickups.

Two comb filters are connected in series in the above-described prior art musical tone signal forming apparatus. Therefore, in order to control the level of a signal provided with musical tone by this apparatus, a level controller should be connected in series with the comb filters. Accordingly, this apparatus is not suitable for producing a timbred musical sound signal by individually controlling the levels of respective signals detected by imaginary pickups.

In a musical tone signal forming apparatus having serially connected comb filters, it is difficult to simulate a signal formed by combining signals detected by three or more pickups because of difficulty and complexity in properly setting delay times which are imparted by delays in the respective comb filters.

In addition, in a musical tone signal forming apparatus having a plurality of comb filters connected in series, each comb filter must include a delay, which complicates the apparatus.

Therefore, an object of the present invention is to provide a musical tone signal forming apparatus which can be easily adjusted to produce a signal comparable to a composite signal formed by string vibration signals detected by a plurality of pickups, and musical sound signals with a variety of musical tones.

Another object of the present invention is to provide a musical tone signal forming apparatus with a simple structure.

Still another object of the present invention is to provide a musical tone signal forming apparatus including comb filters connected in parallel.

SUMMARY OF INVENTION

According to the present invention, a musical tone (timbre) signal forming apparatus has an input terminal to which an audio frequency signal is applied from a sound source. First delay means imparts a first delay time to the signal applied thereto from the input terminal. Second delay means imparts a second delay time, shorter than the first delay time, to the signal applied thereto from the input terminal. Further, third delay means imparts a third delay time, which is shorter than the first delay time but longer than the second delay time, to the signal applied thereto from the input terminal. First comb filter means includes the input terminal and the first delay means and combines the signal from the input terminal with a first delayed signal from the first delay means. The second comb filter means includes the second and third delay means and combines a second delayed signal from the second delay means with a third delayed signal from the third delay means. Means is provided for combining signals from the first and second comb filter means.

Each of the first and second comb filter means may include level control means for controlling the level of the output signal which that comb filter means develops.

A plurality of such second comb filter means may be used. The second and third delay times of the second and third delay means of the respective second comb filter means differ from other ones of the second comb filter means.

The audio frequency signal may be a detected string vibration signal. The first delay time is determined in accordance with the distance between the fixation position where the string is fixed and a first imaginary pickup supposed to be located at an arbitrary position along the string. The second delay time is determined in accordance with the distance between the first imaginary pickup and a second imaginary pickup supposed to be located at a position nearer to the fixation position than the first imaginary pickup. The third delay time is determined in accordance with the distance between the fixation position and the mid-point between the first and second imaginary pickups.

According to another aspect of the invention, the musical tone signal forming apparatus includes delay means having an input at which an audio frequency signal is applied. The delay means includes a plurality of delay stages. First comb filter means includes the delay means and combines the signal at the input of the delay means and a delayed signal at an output of the delay means. Second comb filter means includes the delay means and combines delayed signals derived from intermediate delay stages of the delay means spaced from each other by a predetermined number of stages. Combining means combines signals from the first and second comb filter means.

The first and second comb filter means may include level control means for controlling the levels of the respective output signals thereof.

A plurality of such second comb filter means may be used. In this case, at least one of the intermediate delay stages of each of the plurality of second comb filter means from which delayed signals are derived is spaced from the input of the delay means by a different number of stages than the intermediate stages of the other ones of the plurality of second comb filter means from which delayed signals are derived.

The audio frequency signal may be a string vibration signal which results from detecting vibrations of the string.

The intermediate delay stages of the delay means of the second comb filter means from which signals to be combined in the second comb filter means are derived may be spaced from the center delay stage by an equal number of stages in opposite directions.

In the first comb filter means, the delay time imparted by the delay means to the audio frequency signal as applied to the input of said delay means may be determined by the distance between the fixation position and the first imaginary pickup, and, in the second comb filter means, the intermediate stages from which delayed signals are derived are determined by the distance between the first imaginary pickup and the second imaginary pickup and by the distance between the fixation position and the mid-point between the first and second imaginary pickups.

DESCRIPTION OF PREFERRED EMBODIMENTS

Before describing a musical tone signal forming apparatus of the present invention, the principle of the present invention is explained.

Figure 1:
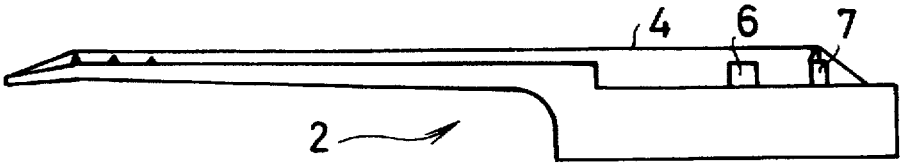
FIG. 1 shows an electric guitar producing a string vibration signal, which is detected by a pickup and applied to a musical tone signal forming apparatus according to the present invention.

Referring to FIG. 1, an electric guitar 2 includes a plurality of strings including a string 4 which provide a sound source. The strings other than the string 4 are no shown for the simplicity purpose. Vibrations of the string 4 are detected by a pickup 6 which is disposed at an arbitrary distance along the length of the string 4 from a string fixing section, for example, a bridge 7. Now, let us consider producing a signal which could be detected if a humbacking pickup were used or if half-tone setting were employed, by filtering a signal representing the detected vibrations. Let it be assumed that the pickup 6 is a divided pickup which can detect vibrations of the single string 4 independent of other strings of the electric guitar 2.

For example, as shown in FIGS. 2(*a*) and 2(*b*), the vibrations of the string 4 are detected by two divided pickups 8 and 10 located along the string 4. Two signals from the pickups 8 and 10 are combined. The pickup 8 is disposed at a distance $x_1$ from the bridge 7 which fixes the strings including the string 4 to a guitar body, while the pickup 10 is disposed at a distance $x_2$ from the bridge 7, where $x_1>x_2$.

Figure 2A:
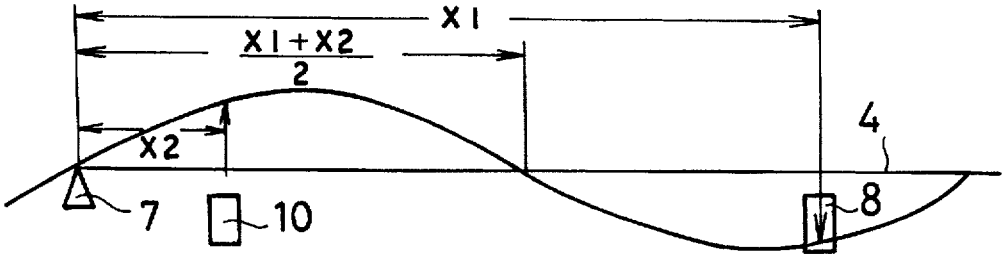
FIG. 2*a* illustrates one string vibration which would be detected when two pickups are used in the electric guitar shown in FIG. 1.

A signal resulting from combining vibration signals detected by the two pickups 8 and 10 is the product of two signals. One of the two signals has a frequency characteristic exhibiting dips or nulls at such frequencies that components at the frequencies have nodes at a position corresponding to the mid-point between the two pickups 8 and 10, namely, at a point expressed as $(x_1+x_2)/2$, as shown in FIG. 2*a*. The other of the two signals has a frequency characteristic exhibiting dips at a frequency that a component at the frequency has a half-wavelength equal to the spacing between the pickups 8 and 10, i.e. $(x_1-x_2)$, and at its odd multiples.

This can be understood from the following computations. Let it be assumed that, for example, the string 4 in its open state has a length L, and the distance from the bridge 7 to a pickup is x. The signal detected by the pickup is expressed as:

$$\sin(x/L)n\pi$$

where n is a harmonic. Accordingly, the signal resulting from combining the signals detected by the pickups 8 and 10 disposed at the aforementioned locations $x_1$ and $x_2$ can be expressed by the following expression.

$$\sin[(x_1/L)n\pi]+\sin[(x_2/L)n\pi]=2\sin[\{(x_1+x_2)/2L\}n\pi]\cdot\cos[\{(x_1-x_2)/L\}n\pi] \quad (1)$$

The first and second terms of the right side of the expression (1) correspond to the components shown in FIG. 2(*a*) and 2(*b*), respectively.

Figure 3:
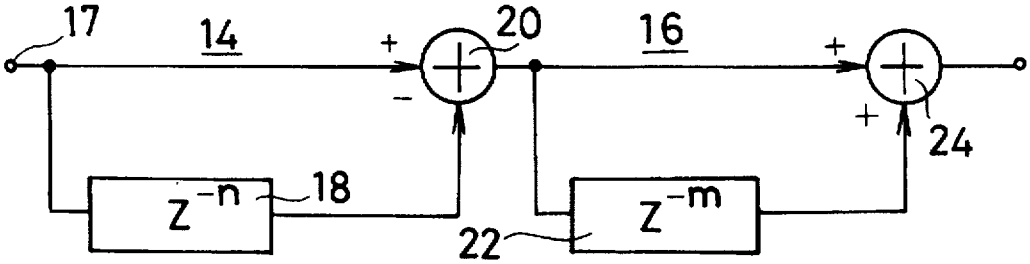
FIG. 3 is a block diagram of serially connected filter circuits for simulating string vibration signals shown in FIGS. 2*a* and 2*b*.

In order to produce the signal expressed by this expression (1) from the string vibration signal detected by the single pickup 6, or, in other words, in order to simulate the signals from imaginary pickups 8 and 10 from the string vibration signal detected by the pickup 6, the string vibration signal from the pickup 6 is sampled in an A/D converter (not shown) with a predetermined sampling period to convert it into a digital string vibration signal, and, then, the digital signal is applied to two serially connected comb filters 14 and 16, for example, shown in FIG. 3 through an input terminal 17.

The comb filter 14 includes a delay 18 which imparts a delay time corresponding to n sampling periods to a digital string vibration signal applied thereto. A subtractor 20 subtracts the output of the delay 18 from the digital string vibration signal applied thereto from the input terminal 17. The comb filter 14 has a high-pass filter type frequency characteristic having dips at integer multiples of a fundamental frequency F, namely, 0F, 1F, 2F, 3F, . . . .

The comb filter 16 includes a delay 22 which imparts a delay time corresponding to m sampling periods to the output of the subtractor 20 applied thereto. The delay output of the delay 22 and the output of the subtractor 20 are summed in an adder 24. The comb filter 16 exhibits a low-pass filter type frequency characteristic having dips at odd multiples of a fundamental frequency F', namely, 1F', 3F', 5F', 7F', . . . .

The transfer function H of the series combination of the digital comb filters 14 and 16 can be expressed by the following expression (2).

$$H=(1-Z^{-n})(1+Z^{-m}) \quad (2)$$

where n is determined in accordance with the distance from the bridge 7 to the mid-point between the two pickups 8 and 10, i.e. $(x_1+x_2)/2$, and m is determined by one-half of the distance between the pickups 8 and 10, i.e. $(x_1-x_2)/2$.

Figure 4:
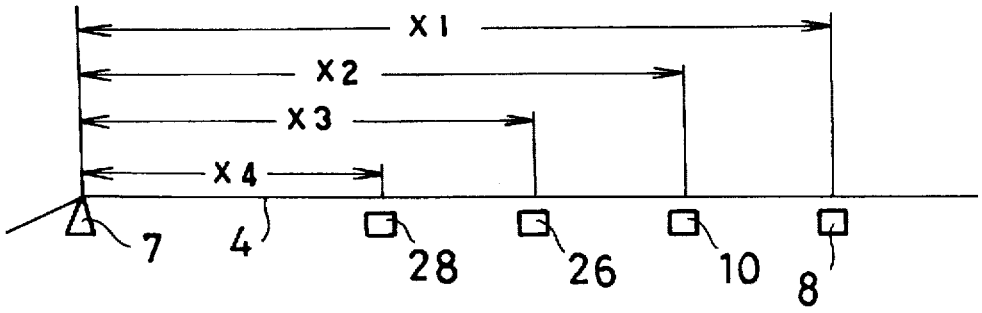
FIG. 4 shows a plurality of pickups disposed along a string of an electric guitar.

In the musical tone signal forming apparatus including two digital comb filters connected in series, delay times provided by delay means must be set in accordance with the location of the midpoint between the two pickups 8 and 10 and the difference between the distances to the two pickups 8 and 10 from the bridge 7. It is very troublesome to an electric guitar player to set such delay times. Particularly, if signals from three or more imaginary pickups, for example, 8, 10, 26 and 28 as shown in FIG. 4, are to be simulated, four comb filters must be connected in series. In such a case, it is far more troublesome to properly set the delay times for the respective comb filters. The difficulty increases when the player wants to individually control the detection levels of the imaginary pickups 8, 10, 26 and 28 to produce musical sounds of a variety of timbres.

The transfer function H of the comb filters 14 and 16 connected in series shown in FIG. 3 can be transformed to the following expression (3).

$$\begin{aligned}(1-Z^{-n})(1+Z^{-m}) &= 1+Z^{-m}-Z^{-n}-Z^{-(n+m)} \\ &= (1-Z^{-(n+m)})+(Z^{-m}-Z^{-n})\end{aligned} \quad (3)$$

Figure 5:
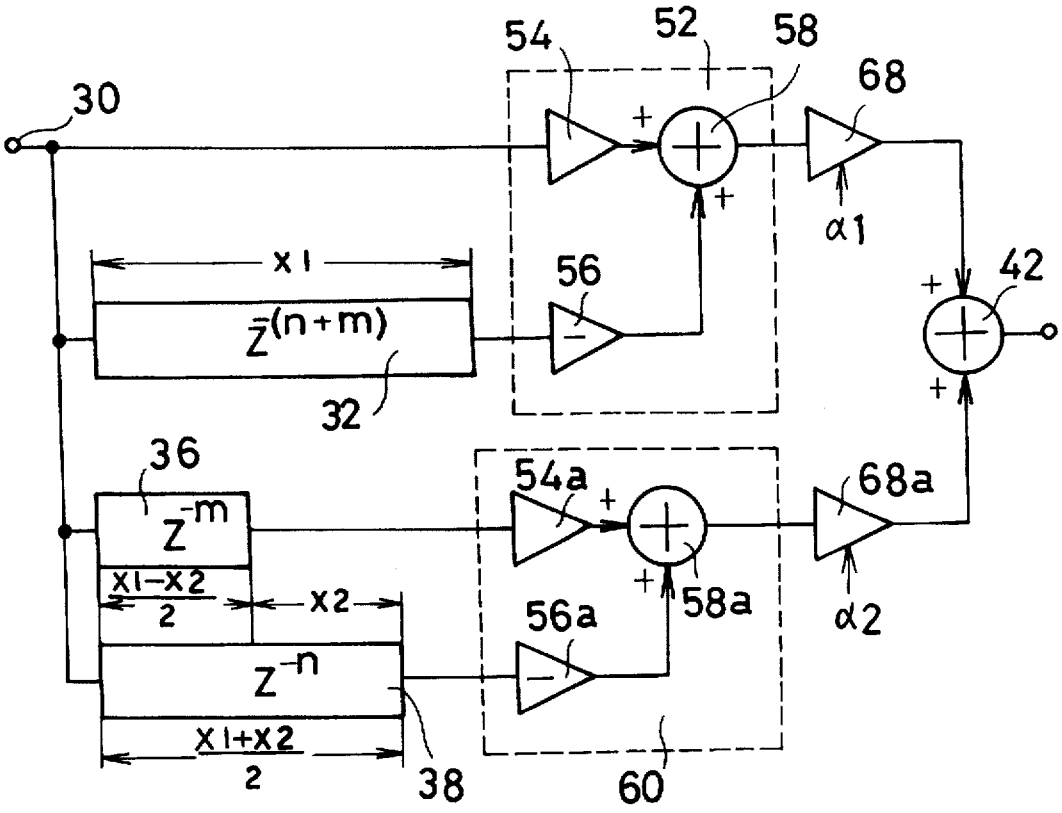
FIG. 5 is a block diagram of a musical tone signal forming apparatus according to one embodiment of the present invention.

A musical tone signal forming apparatus according to a first embodiment of the present invention arranged in accordance with the expression (3) is shown in FIG. 5.

In the musical tone signal forming apparatus shown in FIG. 5, a string vibration signal detected by the pickup 6 is sampled at a predetermined sampling period and converted into a digital string vibration signal in an A/D converter (not shown). The digital string vibration signal is applied to an input terminal 30. The musical tone signal forming apparatus includes first delay means, e.g. a first delay 32, which imparts a delay time corresponding to (n+m) sampling periods to the digital string vibration signal. The delay output from the delay 32 and the digital string vibration signal applied to the input terminal 30 are combined in combining means, e.g. a combiner 52. The combinet 52 includes a buffer 54 to which the digital string vibration signal is applied from the input terminal 30, an inverter 56 which inverts the delayed signal from the first delay 32, and an adder 58 which sums the outputs of the buffer 54 and the inverter 56. Thus, the combinet 52 functions as a subtractor for subtracting the delayed signal provided by the first delay 32 from the digital string vibration signal applied at the input terminal 30. The input terminal 30, the first delay 32 and the combiner 52 form a first comb filter.

The musical tone signal forming apparatus further includes a second delay 36 for imparting a delay time corresponding to m sampling periods to the digital string vibration signal and a third delay 38 for imparting a delay time corresponding to n sampling periods to the digital string vibration signal. The outputs of the second and third delays 36 and 38 are combined in a combiner 60. Similar to the combiner 52, the combiner 60 includes a buffer 54*a*, an inverter 56*a* and an adder 58*a*. Thus, the combiner 60 functions as a subtractor for subtracting the delayed signal from the third delay 38 from the delayed signal from the second delay 36. The second and third delays 36 and 38 and the combiner 60 form a second comb filter.

The levels of the output signals of the combiners 52 and 60, i.e. the output signals of the first and second comb filters, are controled by level control means, e.g. multipliers 68 and 68*a*, associated respectively with the first and second comb filters, and the level-controlled signals are, then, combined with each other in combining means, e.g. an adder 42. Using different coefficients $\alpha 1$ and $\alpha 2$ for the multipliers 68 and 68*a*, each of the output levels of the first and second comb filters can be individually adjusted without affecting the output level of the other comb filter.

As described above, the musical tone signal forming apparatus includes two comb filters which are connected in parallel.

Figure 2B:
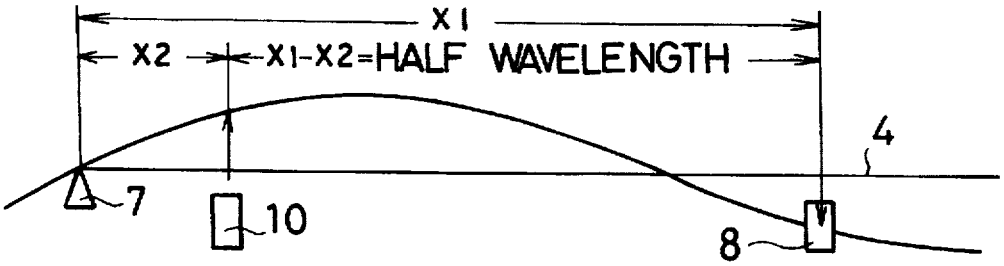
FIG. 2*b* illustrates another string vibration which would be detected by the two pickups shown in FIG. 1.

The length, i.e. the number of delay stages (n+m), of the first delay 32 is determined by the distance $x_1$ from the imaginary pickup 8 to the bridge 7 shown in FIGS. 2*a* and 2*b*, using the following expression (4).

$$(n+m)=[x_1/(L\cdot f_0)]f_s \quad (4)$$

where L is the length of the string 4 in its open state, $f_0$ is the vibration frequency of the string 4 in its open state, and $f_s$ is a sampling frequency. The term $x_1/(L\cdot f_0)$ represents the period of a signal waveform of which one wavelength is equal to the distance from the imaginary pickup 8 to the bridge 7. Accordingly, the expression (4) expresses what multiple of the sampling period the period of the signal waveform is. Thus, the first comb filter is a high-pass filter which has dips at a fundamental frequency corresponding to a wavelength equal to the distance from the imaginary pickup 8 to the bridge 7 and at the multiples of the fundamental frequency. The signal provided by the first comb filter is equivalent to a signal which would be detected by the imaginary pickup 8.

Similarly, the length m of the delay 36 can be determined by substituting one-half of the spacing between the pickup 8 and the pickup 10, namely, $(x_1-x_2)/2$, for "$x_1$" in the expression (4). Thus, the expression for the length m is $$m=[\{(x_1-x_2)/2\}/(L\cdot f_0)]f_s$$

The length n of the delay 38 can be determined by substituting $(x_1+x_2)/2$, which is the distance from the mid-point between the pickups 8 and 10 to the bridge 7, for "$x_1$" in the expression (4). Thus, the expression for the length n is $$n=[\{(x_1+x_2)/2\}/(L\cdot f_0)]f_s$$

The difference in delay time between the delay 36 and the delay 38 corresponds to the distance $x_2$ of the imaginary pickup 10 from the bridge 7. Thus, the second comb filter is a high pass filter having dips at a fundamental frequency corresponding to a wavelength equal to the distance from the imaginary pickup 10 to the bridge 7 and at the multiples of the fundamental frequency. The signal provided by the second comb filter is equivalent to a signal which would be detected by the imaginary pickup 10.

As described above, the delay time imparted by the first delay 32 is the longest of all. The delay time imparted by the second delay 36 is shorter than the time imparted by the first delay 32. The delay time imparted by the third delay 38 is shorter than the delay time imparted by the first delay 32, but is longer than the delay time imparted by the delay 36.

As described above, the musical tone signal forming apparatus shown in FIG. 5 simulates the signals which would be provided by the two imaginary pickups 8 and 10 by the use of comb filters connected in parallel. Accordingly, by expanding this concept, signals which would be provided by a larger number of imaginary pickups can be simulated. In addition, the levels of the signals for the respective imaginary pickups can be individually and freely adjusted.

In place of the buffers 54 and 54*a* in FIG. 5, multipliers with positive multiplication factors may be used together with multipliers with negative multiplication factors in place of the inverters 56 and 56*a*, whereby level control is performed in the combiners 52 and 60. In this case, it is preferable that the positive and negative multiplication factors in each combiner have the same absolute value. With this arrangement, the multipliers 68 and 68*a* for level control may be omitted.

Figure 6:
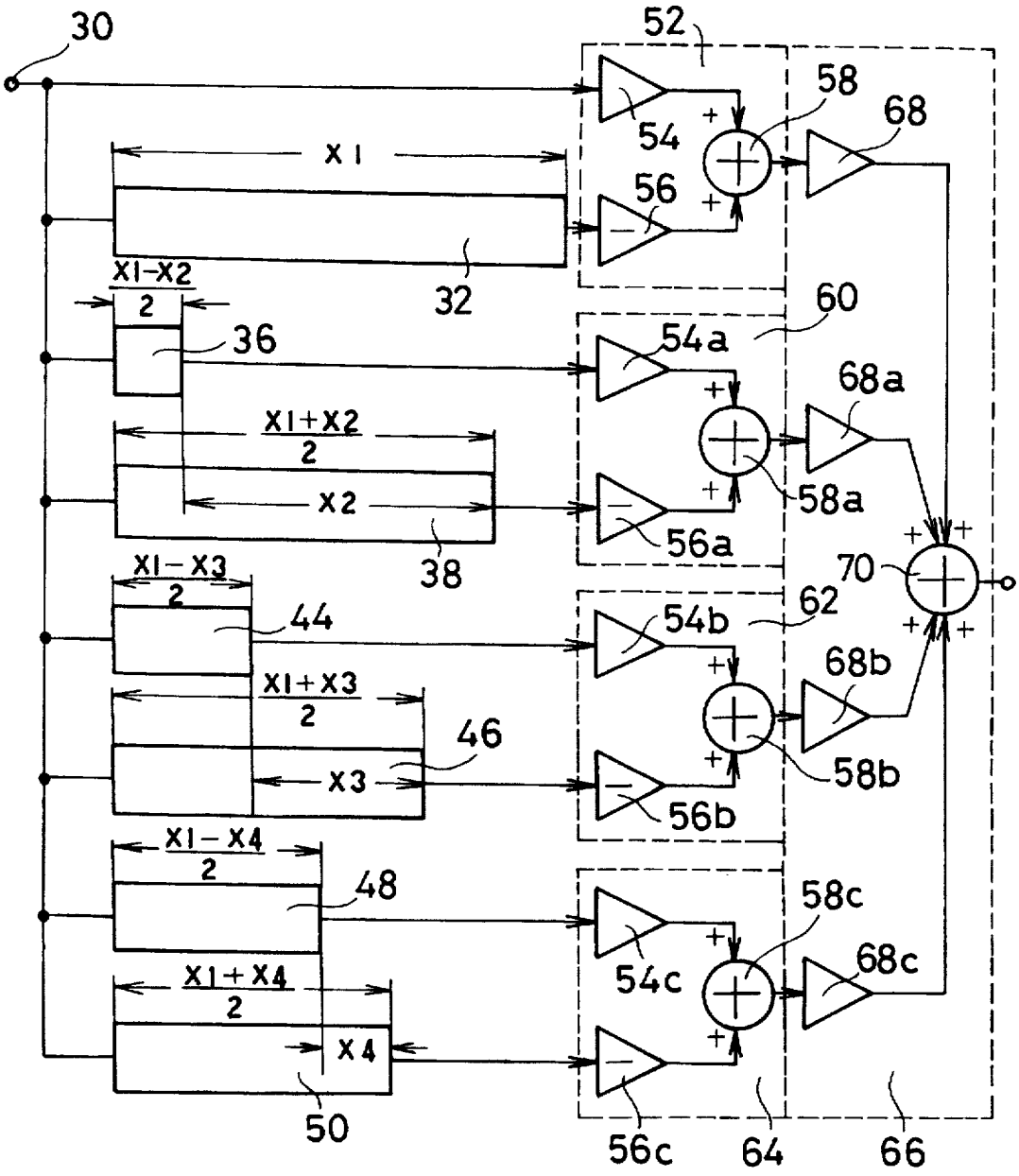
FIG. 6 is a block diagram of a musical tone signal forming apparatus according to another embodiment of the present invention.

FIG. 6 shows a musical tone signal forming apparatus according to another embodiment of the present invention which can simulate, from the signal detected by the pickup 6, a signal which would result from combining signals detected by the four imaginary pickups 8, 10, 26 and 28 shown in FIG. 4. The pickups are assumed to be positioned at distances $x_1$, $x_2$, $x_3$ and $x_4$ from the bridge 7, respectively, where $x_1>x_2>x_3>x_4$.

For the imaginary pickups 8 and 10, delays 32, 36 and 38 similar to the delays 32, 36 and 38 of FIG. 5 are arranged. For the imaginary pickup 26, delays 44 and 46 are arranged. The length of the delay 44 is determined by substituting one-half of the distance between the imaginary pickups 8 and 26, namely, $(x_1-x_3)/2$, for "$x_1$" in the expression (4). The length of the delay 46 is determined by substituting the distance from the mid-point between the imaginary pickups 8 and 26 to the bridge 7, namely, $(x_1+x_3)/2$, for "$x_1$" in the expression (4).

Delays 48 and 50 are for the imaginary pickup 28. The length of the delay 48 is determined by substituting one-half of the distance between the imaginary pickups 8 and 28, namely, $(x_1-x_4)/2$, for "$x_1$" in the expression (4). The length of the delay 50 is determined by substituting the distance from the mid-point between the pickups 8 and 28 to the bridge 7, namely, $(x_1+x_4)/2$, for "$x_1$" in the expression (4).

A digital string vibration signal is applied through an input terminal 30 to the respective delays 32, 36, 38, 44, 46, 48 and 50. The digital string vibration signal from the input terminal 30 and the delayed signal from the delay 32 are combined in a combiner 52 similar to the combiner 52 of FIG. 5. The input terminal 30, the delay 32 and the combiner 52 form a first comb filter.

The delayed signals from the delays 36 and 38 are combined with each other in a combiner 60 similar to the combiner 60 of FIG. 5.

The delayed signals from the delays 44 and 46 are combined with each other in a combiner 62 which is constructed similar to the combiner 60 and includes a buffer 54*b*, an inverter 56*b* and an adder 58*b*.

The delayed signals from the delays 48 and 50 are combined with each other in a combiner 64 which is constructed similar to the combiner 60 and includes a buffer 54*c*, an inverter 56*c* and an adder 58*c*.

The delays 36 and 38, 44 and 46, and 48 and 50 and the combiners 60, 62, and 64 form three second comb filters.

As in the embodiment shown in FIG. 5, a multiplier having a positive multiplication factor may be used in place of each of the buffers 54, 54*a*, 54*b* and 54*c*, with a multiplier having a negative multiplication factor used in place of each of the inverters 56, 56*a*, 56*b* and 56*c*, to control signal levels in the combiners 52, 60, 62 and 64. In this case, too, the positive and negative multiplication factors in each combinet desirably have the same absolute value.

The outputs of the combiners 52, 60, 62 and 64 are combined in a combiner 66. The combiner 66 includes level control means, e.g. multipliers 68, 68*a*, 68*b* and 68*c*, for controlling the levels of the outputs of the respective combiners 52, 60, 62 and 64, and combining means, e.g. an adder 70, for combining the outputs of the multipliers 68, 68*a*, 68*b* and 68*c*.

The use of the multipliers 68, 68*a*, 68*b* and 68*c* in the combinet 66 for controlling the output levels of the combiners 52, 60, 62 and 64 permits free and individual control of the levels of the signals simulating the string vibration signals which could be detected by the imaginary pickups 8, 10, 26 and 28. This permits providing a variety of musical tones or timbres to a musical sound produced by the instrument.

The musical tone signal forming apparatus shown in FIG. 6 includes a number of delays, and, therefore, the configuration is complicated.

Figure 7:
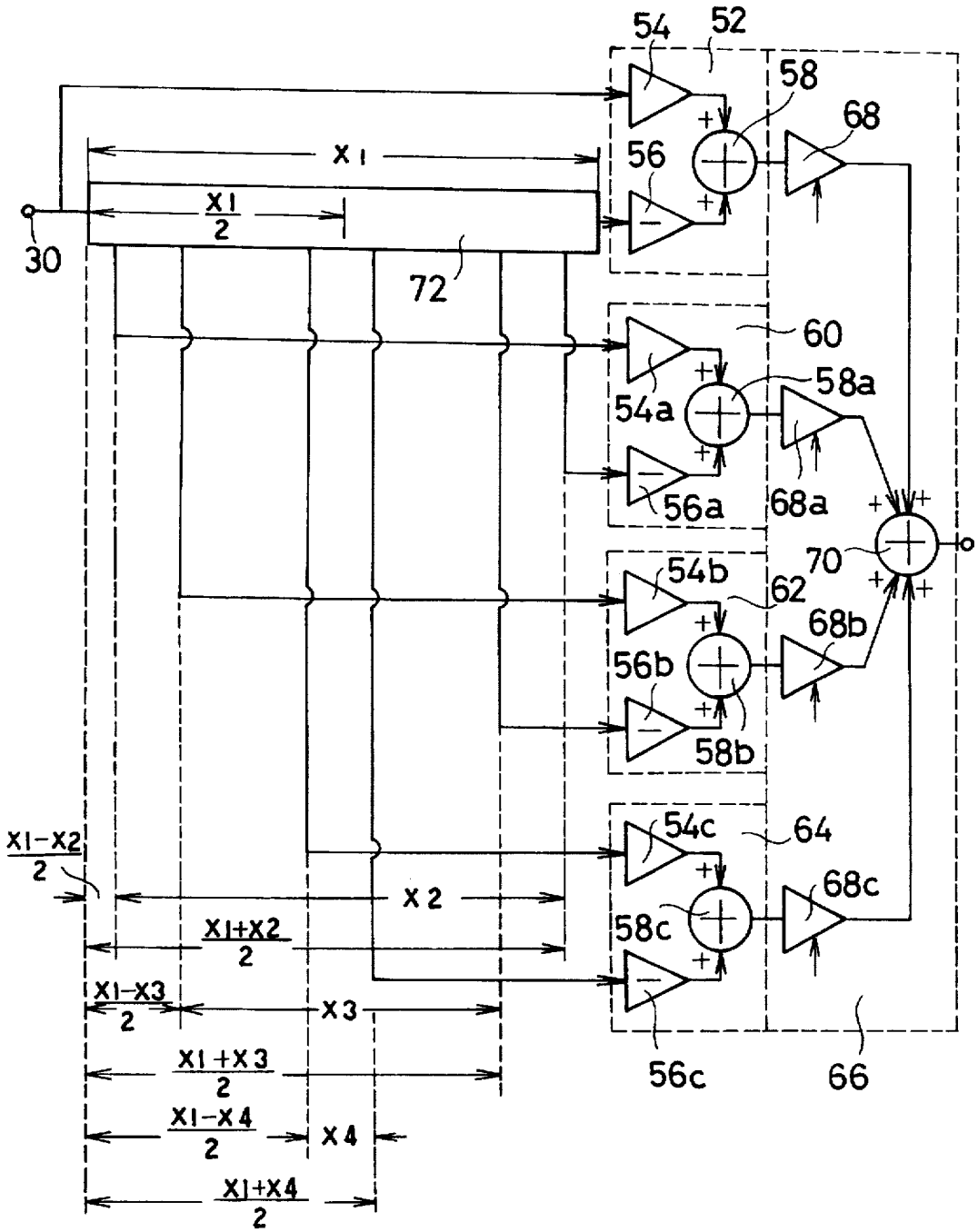
FIG. 7 is a block diagram of a musical tone signal forming apparatus according to still another embodiment of the present invention.

FIG. 7 shows an improvement on the apparatus shown in FIG. 6.

The musical tone signal forming apparatus of FIG. 7 includes substantially the same components as the apparatus of FIG. 6, except that a single delay 72 is used in place of the delays 32, 36, 38, 44, 46, 48 and 50. Accordingly, those components which are used in the apparatus of FIG. 6 are not described in detail.

The delay 72 receives a signal detected by the pickup 6 shown in FIG. 1, and digitized and applied to the input terminal 30. The length or the number of stages of the delay 72 is determined in accordance with the expression (4), based on the distance $x_1$ from the imaginary pickup 8 to the bridge 7 (FIG. 4). The digital string vibration signal at the input terminal 30 is also applied to the buffer 54 of the combiner 52. The delayed signal from the output of the final stage of the delay 72 is applied to the inverter 56 of the combiner 52. The input terminal 30, the delay 72 and the combiner 52 form a first comb filter.

The buffer 54*a* of the combiner 60 receives the delayed signal derived from the output of one of the intermediate stages, i.e. the stages between the input stage and the final stage, of the delay 72 which is determined by substituting one-half of the spacing between the imaginary pickups 8 and 10, i.e. $(x_1-x_2)/2$, for "$x_1$" in the expression (4). The inverter 56*a* of the combinet 60 receives the delayed signal from the output of one of the intermediate stages of the delay 72 which is determined by substituting the distance from the bridge 7 to the mid-point between the imaginary pickups 8 and 10, i.e. $(x_1+x_2)/2$, for "$x_1$" in the expression (4). The buffer 54*b* of the combiner 62 receives the delayed signal derived from the output of one of the intermediate stages of the delay 72 which is determined by substituting one-half of the spacing between the imaginary pickups 8 and 26, i.e. $(x_1-x_3)/2$, for "$x_1$" in the expression (4). The inverter 56*b* of the combiner 62 receives the delayed signal from the output of one of the intermediate stages of the delay 72 which is determined by substituting the distance from the bridge 7 to the mid-point between the imaginary pickups 8 and 26, i.e. $(x_1+x_3)/2$, for "$x_1$" in the expression (4).

The buffer 54*c* of the combiner 64 receives the delayed signal derived from the output of one of the intermediate stages of the delay 72 which is determined by substituting one-half of the spacing between the imaginary pickups 8 and 28, i.e. $(x_1-x_4)/2$, for "$x_1$" in the expression (4). The inverter 56*c* of the combiner 64 receives the delayed signal from the output of one of the intermediate stages of the delay 72 which is determined by substituting the distance from the bridge 7 to the mid-point between the imaginary pickups 8 and 28, i.e. $(x_1+x_4)/2$, for "$x_1$" in the expression (4).

The combiner 52 receives signals from the input terminal 30 and the output of the final stage of the delay 72 which are at the same distances in the opposite directions from the center stage of the delay 72, i.e. from the location corresponding to $x_1/2$ from the bridge 7. Similarly, the combiner 60 receives delayed signals derived from the outputs of the stages corresponding to $(x_1+x_2)/2$ and $(x_1-x_2)/2$, respectively, which are also at the same distance in the opposite directions from the center stage of the delay.

This holds true for the combiners 62 and 64, too.

The single delay 72 with its intermediate stages providing delayed signals, and the combiners 52, 60, 62 and 64 form the first and second comb filters, and the outputs from the respective comb filters are then combined in the combiner 66. Thus, the circuit configuration of the apparatus of FIG. 7 is simple relative to the apparatus of FIG. 6.

The present invention has been described with reference to the single string 4 of the electric guitar 2. String vibration signals from other strings may be detected by associated pickups and filtered in a manner similar to the one described above.

The signal to be applied to the input terminal 30 is not limited to string vibration signals, but other types of musical sound signals, such as signals prepared by a sampler which samples not only string vibration signals but also musical sound signals similar to string vibration signals, and signals from synthesizers may be also applied to the terminal 30. Furthermore, musical sound signals from, for example, electronic instruments which produce musical sound signals which are quite different from string vibration signals may be applied to the input terminal 30.

What is claimed is:

1. A musical tone signal forming apparatus for use in simulating a tone of a string instrument, said apparatus comprising:

an input terminal at which an audio frequency signal from a sound source is applied;

first delay means for imparting a first delay time to said signal at said input terminal and developing a first delayed signal at an output thereof, second delay means for imparting a second delay time to said signal from said input terminal and developing a second delayed signal at an output thereof, said second delay time being shorter than said first delay time;

third delay means for imparting a third delay time to said signal from said input terminal and developing a third delayed signal at an output thereof, said third delay time being shorter than said first delay time but longer than said second delay time;

first comb filter means including said input terminal and said first delay means, for combining said audio frequency signal applied thereto from said input terminal and said first delayed signal;

second comb filter means including said second and third delay means for combining said second and third delayed signals; and combining means for combining output signals from said first and second comb filter means;

wherein said first, second and third delay times are determined to enable said first and second comb filter means to realize frequency characteristics of a composite sisal resulting from combining string vibration signals of said string instrument which would be detected if at least two imaginary pickups were disposed at different locations along the tenth of a string of said string instrument whereby a tone signal is generated, said tone sisal simulating a tone which said composite signal would produce.

2. The musical tone signal forming apparatus according to claim 1 wherein each of said first and second comb filter means includes level control means for controlling the level of the output signal thereof.

3. The musical tone signal forming apparatus according to claim 1, further comprising a plurality of second comb filter means each including second and third delay means, the second and third delay times imparted by said second and third delay means of each of said plurality of second comb filter means differing from the second and third delay times imparted by said second and third delay means of remaining ones of said plurality of second comb filter means.

4. The musical tone signal forming apparatus according to claim 1, wherein said audio frequency signal is a vibration signal resulting from detecting vibrations of a string;

said first delay time is determined based on a distance between a fixation position where said string is fixed and a first imaginary pickup positioned at an arbitrary location along said string;

said second delay time is determined based on a distance between said first imaginary pickup and a second imaginary pickup positioned at a location closer to said fixation position than said first imaginary pickup; and said third delay time is determined based on a distance between said fixation position and a mid-point between said first and second imaginary pickups.

5. A musical tone signal forming apparatus for use in simulating a tone of a string instrument, said apparatus comprising:

delay means having an input to which an audio frequency signal is applied, said delay means including a plurality of delaying stages;

first comb filter means including said delay means for combining said audio frequency signal at said input of said delay means and a delayed signal at the output of said delay means;

second comb filter means including said delay means for combining delayed signals derived from intermediate delaying stages of said delay means spaced by a predetermined number of delaying stages from each other; and combining means for combining output signals of said first and second comb filter means;

wherein the number of said delaying stages and said intermediate delaying stages are determined to enable said first and second comb filter means to realize frequency characteristics of a composite signal resulting from combining string vibration signals of said string instrument which would be detected if at least two imaginary pickups were disposed at different locations along the length of a string of said string instrument, whereby a tone signal is generated, said tone signal simulating a tone which said composite signal would produce.

6. The musical tone signal forming apparatus according to claim 5 wherein each of said first and second comb filter means includes level control means for controlling the level of the output signal thereof.

7. The musical tone signal forming apparatus according to claim 5, further comprising a plurality of second comb filter means wherein at least one of the intermediate delaying stages from which delayed signals are derived in each of said plurality of second comb filter means is spaced from said input of said delay means by a different number of delaying stages than the intermediate delaying stages from which delayed signals are derived in remaining ones of said plurality of second comb filter means.

8. The musical tone signal forming apparatus according to claim 5, wherein said audio frequency signal is a vibration signal resulting from detecting vibrations of a string.

9. The musical tone signal forming apparatus according to claim 5, wherein said delayed signals derived from the intermediate delaying stages of said delay means of said second comb filter means are derived from delaying stages which are spaced from a center delaying stage of said delay means in opposite directions by an equal number of delaying stages.

10. The musical tone signal forming apparatus according to claim 8, wherein in said first comb filter means, the delay time imparted by said delay means to said audio frequency signal as applied to said input of said delay means is determined by a distance between a fixation position where said string is fixed and a first imaginary pickup positioned at an arbitrary location along said string; and in said second comb filter means, the intermediate delaying stages from which delayed signals are derived are determined by a distance between said first imaginary pickup and a second imaginary pickup positioned at a location closer to said fixation position that said first imaginary pickup, and by a distance between the fixation position and a mid-point between said first and second imaginary pickups.

11. A musical tone signal forming apparatus for use in simulating a tone of a string instrument, said apparatus comprising:

an input terminal at which an audio frequency signal from a sound source is applied;

a first delay connected to said input terminal and imparting a first delay time to said audio frequency signal, said first delay outputting a first delayed signal at an output thereof, a second delay connected to said input terminal and imparting a second delay time to said audio frequency signal, said second delay outputting a second delayed signal at an output thereof, said second delay time being shorter than said first delay time;

a third delay connected to said input terminal and imparting a third delay time to said audio frequency signal, said third delay outputting a third delayed signal at an output thereof, said third delay time being shorter than said first delay time but longer than said second delay time;

a first comb filter including said input terminal and said first delay, said first comb filter combining said audio frequency signal and said first delayed signal to generate a first output signal;

a second comb filter including said second and third delays, said second comb filter combining said second and third delay signals to generate a second output signal; and a combiner, said combiner mixing said first and second output signals from said first and second comb filters;

wherein said first, second and third delay times are determined to enable said first and second comb filters to realize frequency characteristics of a composite signal resulting from combining string vibration signals of said string instrument which would be detected if at least two imaginary pickups were disposed at different locations along the length of a string of said string instrument, whereby a tone signal is generated, said tone signal simulating a tone which said composite signal would produce.

12. The musical tone signal forming apparatus according to claim 11, wherein each of said first and second comb filters includes a level control, said level control receiving a respective one of said first and second output signals and controlling the level thereof.

13. The musical tone signal forming apparatus according to claim 11, further comprising a plurality of second comb filters, each including second and third delays, the second and third delay times imparted by said second and third delays of each of said plurality of second comb filters differing from the second and third delay times imparted by said second and third delays of remaining ones of said plurality of second comb filters.

14. The musical tone signal forming apparatus according to claim 11, wherein said audio frequency signal is a vibration signal resulting from detecting vibrations of a string;

said first delay time is determined based on a distance between a fixation position where said string is fixed and a first imaginary pickup positioned at an arbitrary location along said string;

said second delay time is determined based on a distance between said first imaginary pickup and a second imaginary pickup positioned at a location closer to said fixation position than said first imaginary pickup; and said third delay time is determined based on a distance between said fixation position and a mid-point between said first and second imaginary pickups.

15. A musical tone signal forming apparatus for use in simulating a tone of a string instrument, said apparatus comprising:

a delay having an input to which an audio frequency signal is applied, said delay including a plurality of delaying stages and outputting a delayed signal;

a first comb filter including said delay, said first comb filter combining said audio frequency signal and said delayed signal to generate a first output signal;

a second comb filter including said delay means, said second comb filter combining delayed signals derived from intermediate delaying stages of said delay to generate a second output signal, said intermediate delaying stages spaced by a predetermined number of delaying stages from each other; and a combiner, said combiner mixing said first and second output signals from said first and second comb filters, wherein the number of said delaying stages and said intermediate delaying stages are determined to enable said first and second comb filter means to realize frequency characteristics of a composite signal resulting from combining string vibration signals of said string instrument which would be detected if at least two imaginary pickups were disposed at different locations along the length of a string of said string instrument, whereby a tone signal is generated, said tone signal simulating a tone which said composite signal would produce.

16. The musical tone signal forming apparatus according to claim 15, each of said first and second comb filters including a level control, said level control receiving a respective one of said first and second output signals and controlling a level thereof.

17. The musical tone signal forming apparatus according to claim 15, further comprising a plurality of second comb filters, wherein at least one of said intermediate delaying stages from which delayed signals are derived in each of said plurality of second comb filters is spaced from said input of said delay by a different number of delaying stages than said intermediate delaying stages from which delayed signals are derived in the other ones of said plurality of second comb filters.

18. The musical tone signal forming apparatus according to claim 15, wherein said audio frequency signal is a vibration signal resulting from detecting vibrations of a string.

19. The musical tone signal forming apparatus according to claim 15, wherein said delayed signals derived from the intermediate delaying stages of said delay of said second comb filter are derived from delaying stages which are spaced from a center delaying stage of said delay in opposite directions by an equal number of delaying stages.

20. The musical tone signal forming apparatus according to claim 18, wherein in said first comb filter, the delay time imparted by said delay to said audio frequency signal as applied to said input of said delay is determined by a distance between a fixation position where said string is fixed and a first imaginary pickup positioned at an arbitrary location along said string; and in said second comb filter, said intermediate delaying stages from which delayed signals are derived are determined by a distance between said first imaginary pickup and a second imaginary pickup positioned at a location closer to said fixation position that said first imaginary pickup, and by a distance between the fixation position and a mid-point between said first and second imaginary pickups.

* * * * *